United States Patent [19]

Ballantyne

[11] Patent Number: 4,679,285

[45] Date of Patent: Jul. 14, 1987

[54] METHOD OF MAKING A LUBRICATED HINGE PIN

[75] Inventor: David B. Ballantyne, Bloomfield Hills, Mich.

[73] Assignee: General Motors Corporation, Detroit, Mich.

[21] Appl. No.: 797,957

[22] Filed: Nov. 14, 1985

[51] Int. Cl.[4] ..... B21D 53/40; E05D 5/10

[52] U.S. Cl. ..... 29/11; 29/434; 29/460; 29/512; 29/523; 16/274; 16/386

[58] Field of Search ..... 16/274, 273, 372, 385, 16/387, DIG. 42, 386; 29/11, 434, 460, 522 A, 523, 512

[56] References Cited

U.S. PATENT DOCUMENTS

| | | | |
|---|---|---|---|
| 1,433,095 | 10/1922 | Peary | 16/274 |
| 2,588,216 | 3/1952 | DeGraaf | 16/161 |
| 2,588,258 | 3/1952 | Lowman | 16/133 |
| 3,407,903 | 10/1968 | Sansabrino | 16/274 |

FOREIGN PATENT DOCUMENTS

| | | | |
|---|---|---|---|
| 13878 | of 1899 | United Kingdom | 29/11 |
| 3343 | of 1913 | United Kingdom | 16/274 |

*Primary Examiner*—Fred Silverberg
*Attorney, Agent, or Firm*—R. L. Phillips

[57] ABSTRACT

A lubricated hinge comprises a pair of hinge plates and a lubricant filled hinge pin fitting through barrel sections of the hinge plates so as to pivotally connect same. The hinge pin comprises a hollow cylindrical body. hvaing at one end a radially expansible portion terminating with a stop shoulder and at another end a preformed head and lubricant entrance. The pin body between its ends has lubricant delivery holes for delivering lubricant to between the pin body and the barrel sections of two hinge plates. The pin body is insertable into the barrel sections with the preformed head abutting one side of the hinge and the stop shoulder aligned with an opposite side of the hinge. A shank of a mandrel having an extruding head is insertable through the pin body and is adapted to then be pulled so as to radially expand the expansion portion of the pin body with the extruding head to abut the other side of the hinge and until the extruding head is stopped by the stop shoulder in the pin body. The shank is connected to the extruding head by a breakaway portion which breaks with the extruding head stopped by the stop shoulder upon a predetermined increased pulling force to thereby release the shank for removal from the pin body while the extruding head is sealingly retained to close the one end of said pin body. The other end of the pin body is adapted to receive lubricant through the entrance and thereafter be sealingly closed.

2 Claims, 3 Drawing Figures

METHOD OF MAKING A LUBRICATED HINGE PIN

TECHNICAL FIELD

This invention relates to pin hinges for motor vehicle doors and the like and more particularly to the pin structure and lubrication thereof.

BACKGROUND OF THE INVENTION

The pin hinges used on motor vehicle doors and the like typically employ a pin having a preformed head at one end and a shank that is press-fitted in one of the hinge plates for retention or is upset at the other end at assembly to provide a second head for retention. Lubrication is then typically externally applied to the hinge joint but it has also been proposed to utilize a lubricant impregnated pin, for example.

SUMMARY OF THE INVENTION

The pin hinge of the present invention is simple in structure and assembly and provides improved access for either pressurized or nonpressurized lubrication. The hinge pin comprises a hollow cylindrical body having at one end a radially expansible portion that terminates with a stop shoulder and at another end a preformed head and lubricant entrance. The pin body between these ends is then provided with lubricant delivery holes for delivering lubricant to between the pin body and the hinge plates. The pin body is designed to be insertable into the hinge holes with the preformed head abutting one side of the hinge and the stop shoulder aligned with an opposite side of the hinge.

To this arrangement, there is added a mandrel having an extruding head at one end and a shank that is connected therewith by a breakaway portion. The shank is designed to be insertable through the pin body and then pulled so as to radially expand the expansion portion of the pin body with the extruding head to abut the other side of the hinge. Then by design, the breakaway portion breaks with the extruding head stopped by the stop shoulder to release the shank for removal from the pin body while the extruding head is left permanently sealed and retained by such expansion to close the one end of the pin body. The remainder of the pin body including the other end is thus left open to receive either pressurized or nonpressurized lubricant whereafter it is then adapted to be sealingly closed with a plug.

Thus, it will be appreciated that the hinge pin according to the present invention is very simply assembled in a manner similar to that of a blind pop rivet. Furthermore, the pin hinge assembly of the present invention is ideally suited for motor vehicle mass production with simple conventional tooling as will become more apparent from the following description and drawing of the preferred embodiment.

DESCRIPTION OF THE PREFERRED EMBODIMENT OF THE INVENTION

These and other objects, advantages and features of the present invention will become more apparent from the following description and drawing in which.

Figure 1:
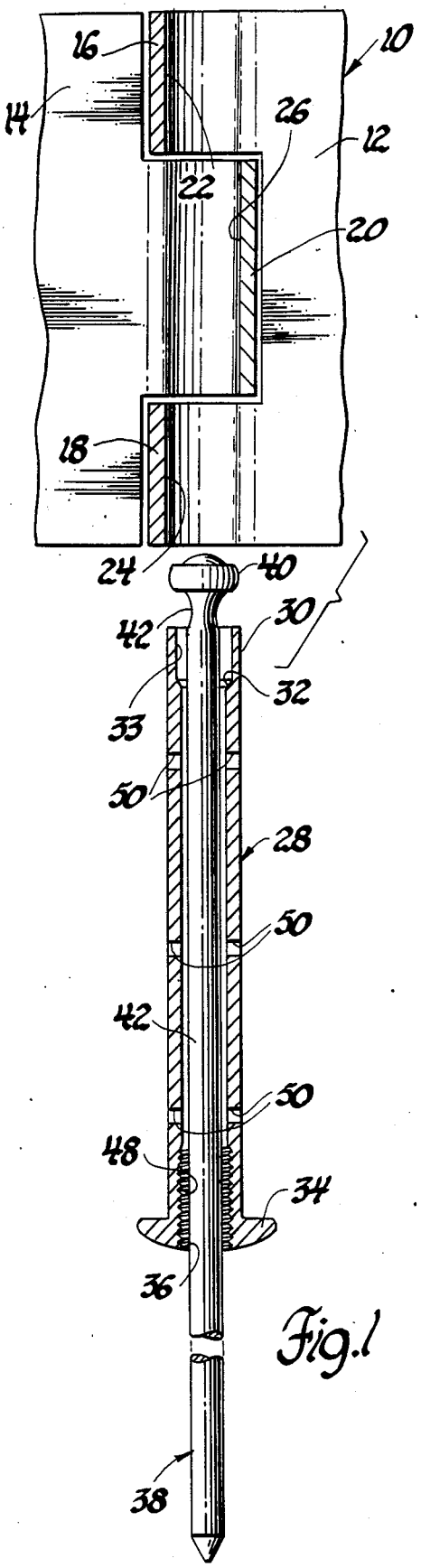
FIG. 1 is a partial exploded view with parts in section of the preferred embodiment of the pin hinge according to the present invention showing the pin body along with mandrel prior to insertion in the hinge plates.

Referring first to FIG. 1, there is shown a lubricated hinge generally designated as 10 for mounting a motor vehicle door and the like. The hinge generally comprises a pair of hinge plates 12 and 14, one of which is connected such as by welding or bolting to the vehicle body door frame (not shown) and the other of which is connected such as by welding or bolting to the vehicle door (not shown) to be hung thereon. The hinge plate 12 is formed with two axially aligned barrel sections 16 and 18 and the other hinge plate 14 is provided with a single but longer barrel section 20 which fits between the two barrel sections 16 and 18 of the former plate. The hinge plate barrel sections 16, 18 and 20 have aligned holes 22, 24 and 26 respectively for receiving a lubricant filled hinge pin comprising a hollow cylindrical body 28.

The hinge pin body 28 has at one end a radially expansible portion 30 of reduced wall thickness terminating with an internal stop shoulder 32 all formed by a counterbore 33 and at the other end has a preformed head 34 and lubricant entrance 36. Prior to or after assembly of the hinge pin body 28 in the hinge plates, a mandrel 38 is inserted in the pin hinge body. The mandrel 38 has an extruding head 40 at one end and a cylindrical shank 42 that is integrally joined to the extruding head by a breakaway portion 42 of reduced diameter.

Figure 2:
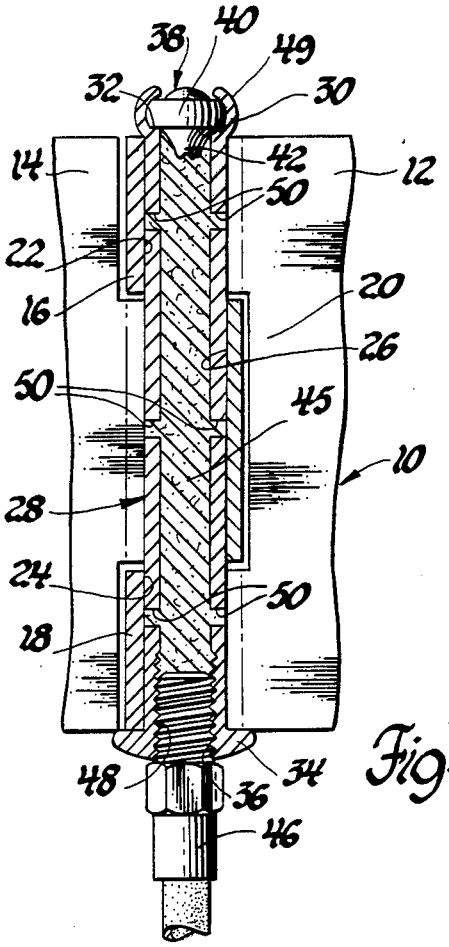
FIG. 2 is a sectional view showing the pin hinge as assembled with the mandrel shank broken off and with a lubricant fitting connected to the pin body.
Figure 3:
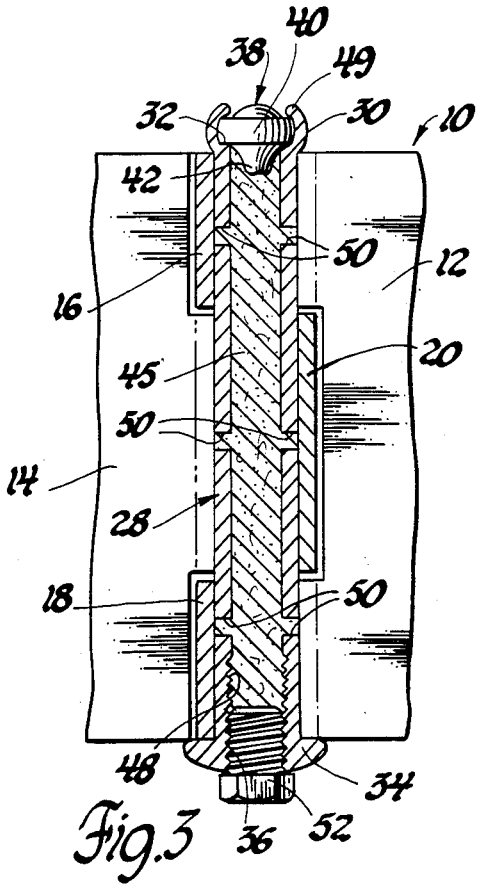
FIG. 3 is a view similar to FIG. 2 but showing the lube fitting removed and a threaded plug closing the pin body.

The pin body 28 is insertable into the hinge holes 22, 26 and 24 with the preformed head 34 abutting the lower side of the hinge as viewed in FIGS. 2 and 3 and the stop shoulder 32 aligned with the opposite or upper side of the hinge as so viewed. With the pin body 28 in position in the hinge plates and the mandrel 38 in position in the pin body with the lower end of the shank 42 extending out therefrom, the latter is then pulled by a suitable conventional pulling tool (not shown) after the manner of a blind rivet so that the extruding head 40 is pulled into the relatively undersize counterbore 33 and radially expands or extrudes the portion 30 of the pin body to abut the other side of the hinge as viewed in FIGS. 2 and 3. Such extrusion continues until the extruding head 40 is stopped by the stop shoulder 32 in the pin body. The breakaway portion 42 is adapted by its reduced diameter or neck to then break upon continued and increased pulling force to thereby release the shank for removal from the pin body leaving the extruding head permanently sealingly closing this end of the pin body. The extruding head is retained by a press fit but for assured retention, it is preferred that the annular edge 49 of the extruded pin body portion 30 also be flanged inwardly as shown to provide a mechanical lock therefor.

Following breakage and removal of the shank, the other end or entrance 36 to the pin body is thus left open to receive lubricant 45 such as under pressure by a lubricant fitting 46 as shown in FIG. 2 for which the pin body is adapted for connection by internal threads 48. The pin body between its ends is provided with lubricant delivery holes 50 at the midpoints of the hinge plate barrel portions 16, 18 and 20 so as to deliver the lubricant to between the pin body and the hinge plates. Following filling of the pin body with lubricant by the fitting 46, the latter is then removed whereafter the lubricant entrance of the pin body is simply closed by a threaded plug 52.

The above described preferred embodiment is illustrative of the invention which may be modified within the scope of the appended claims.

The embodiment of the invention in which an exclusive property or privilege is claimed are defined as follows:

1. A method of making a lubricated hinge pin that fits in axially aligned barrel sections of a pair of hinge plates to pivotally connect same to form a hinge comprising the steps of:

forming the hinge pin as a hollow cylindrical body with an outer diameter that is receivable with a close fit in the barrel sections, forming a radially expansible portion terminating with an internal stop shoulder on one end of the cylindrical body, forming a preformed head and lubricant entrance on the other end of the cylindrical body, forming lubricant delivery holes in the cylindrical body intermediate said ends, forming a mandrel having an extruding head and a shank connected to the extruded head by a breakaway portion, assembling the mandrel in the cylindrical body so that the extruding head is located in said one end and the shank extends through the cylindrical body and outward past said other end, inserting the cylindrical body with the mandrel in the barrel sections with the preformed head abutting one side of the hinge and the stop shoulder aligned with the opposite side of the hinge, pulling the extending portion of the shank so as to radially expand the expansion portion of the cylindrical body with the extruded head to abut said other side of the hinge and until the extruding head is stopped by the stop shoulder and retained by such forming action to close and seal said one end of the cylindrical body, continuing to effect such pulling until the breakaway portion breaks with the extruding head stopped by the stop shoulder to thereby release the shank for removal from the cylindrical body and leave the extruding head in place to permanently close and seal said one end, inserting lubricant in the cylindrical body through said entrance, and sealingly closing said entrance.

2. A method of making a lubricated hinge pin that fits in axially aligned barrel sections of a pair of hinge plates to pivotally connect same to form a hinge comprising the steps of:

forming the hinge pin as a hollow cylindrical body with an outer diameter that is receivable with a close fit in the barrel sections, forming a radially expansible portion terminating with an internal stop shoulder on one end of the cylindrical body, forming a preformed head and a threaded lubricant entrance on the other end of the cylindrical body, forming lubricant delivery holes in the cylindrical body intermediate said ends, forming a mandrel having an extruding head and a cylindrical shank connected to the extruded head by a break away portion of reduced diameter relative to the shank, assembling the mandrel in the cylindrical body so that the extruding head is located in said one end and the shank extends through the cylindrical body and outward past said other end, inserting the cylindrical body with the mandrel in the barrel sections with the preformed head abutting one side of the hinge and the stop shoulder aligned with the opposite side of the hinge, pulling the extending portion of the shank so as to radially expand the expansion portion of the cylindrical body with the extruded head to abut said other side of the hinge and until the extruding head is stopped by the stop shoulder and retained by such forming action to close and seal said one end of the cylindrical body, continuing to effect such pulling until the breakaway portion breaks with the extruding head stopped by the stop shoulder to thereby release the shank for removal from the cylindrical body and leave the extruding head in place to permanently close and seal said one end, inserting lubricant in the cylindrical body through said entrance, and threading a plug into said entrance to sealingly close same.

* * * * *